US005332205A

United States Patent [19]

Chung et al.

[11] Patent Number: 5,332,205

[45] Date of Patent: Jul. 26, 1994

[54] AUTOMATIC DOCUMENT FEEDERS FOR COPYING MACHINES AND METHOD FOR AUTOMATICALLY CONTROLLING SUCH

[75] Inventors: Jae H. Chung, Uijongbu; Young S. Park, Sungdong; Seung M. Chang; Yangchun; Dong S. Joo, Seodaemun; Young J. Kwon, Sungbuk, all of Rep. of Korea

[73] Assignee: Sindo Ricoh Co., Ltd., Seoul, Rep. of Korea

[21] Appl. No.: 908,211

[22] Filed: Jul. 2, 1992

[30] Foreign Application Priority Data

| | | | |
|---|---|---|---|
| Jul. 5, 1991 | [KR] | Rep. of Korea | 1991-11418 |
| Jul. 5, 1991 | [KR] | Rep. of Korea | 1991-11420 |
| Jul. 23, 1991 | [KR] | Rep. of Korea | 1991-11586 |
| Sep. 2, 1991 | [KR] | Rep. of Korea | 1991-15268 |

[51] Int. Cl.[5] ..... B65H 5/22

[52] U.S. Cl. ..... 271/6; 271/225; 271/233; 271/265; 271/266

[58] Field of Search ..... 271/4, 6, 184, 225, 271/233, 265, 266, 119; 355/309, 317

[56] References Cited

U.S. PATENT DOCUMENTS

| | | | |
|---|---|---|---|
| 4,579,327 | 4/1986 | Furuichi | 271/225 X |
| 4,610,533 | 9/1986 | Takahata | 271/6 X |
| 4,621,799 | 11/1986 | Bastow et al. | 271/265 X |
| 4,807,868 | 2/1989 | Hirst et al. | 271/256 |
| 4,864,366 | 9/1989 | Saeki | 271/233 X |
| 4,912,501 | 3/1990 | Saeki et al. | 355/23 |
| 4,933,717 | 6/1990 | Miura et al. | 355/76 |
| 5,001,520 | 3/1991 | Kawano et al. | 271/233 X |
| 5,026,044 | 6/1991 | Ryon et al. | 271/233 X |
| 5,096,177 | 3/1992 | Saeki et al. | 271/119 X |

FOREIGN PATENT DOCUMENTS

| | | | |
|---|---|---|---|
| 0041341 | 2/1988 | Japan | 271/265 |

*Primary Examiner*—D. Glenn Dayoan
*Assistant Examiner*—Carol Lynn Druzbick
*Attorney, Agent, or Firm*—Darby & Darby

[57] ABSTRACT

An automatic document feeder installed on a copying machine. This document feeder is constructed such that one reversible motor provides the drive power for all of drive parts of the document feeder, that is, a document feeding part, a document conveying part and a document recovering part, thus substantially reducing the manufacturing cost of the feeder. The document conveyor belt, on which a document to be copied is closely laid, moves in the forward and reversed direction, thereby causing the document to be exactly set on a reference copying position of a contact glass of the copying machine and, in this respect, improving the operational efficiency of the automatic document feeder. The present invention also provides a control circuit for automatically controlling such an automatic document feeder. The circuit comprises a microprocessor useful for efficiently controlling the operations of the document feeder even in the case of feeding of documents having different sizes and in the case of addition of other operational functions to the document feeder. Furthermore, this document feeder is provided with a document separating belt, which selectively moves and closely contacts with a document separating roller, thus improving the document separating efficiency and lengthening the using life of the document feeding part.

8 Claims, 10 Drawing Sheets

AUTOMATIC DOCUMENT FEEDERS FOR COPYING MACHINES AND METHOD FOR AUTOMATICALLY CONTROLLING SUCH

BACKGROUND OF THE INVENTION

1. Field of the Invention

The present invention relates in general to an automatic document feeder installed on a copying machine, and more particularly to an automatic document feeder which automatically separates and feeds one by one a plurality of documents set on a document feeding base by causing a document to be automatically separated, fed and recovered and permitting a next document to be automatically separated and fed, thereby successively copying the documents one by one, and to a method and apparatus for automatically controlling such a document feeder.

2. Description of the Prior Art

Some of known copying machines is preferably equipped with an automatic document feeder, i.e. what is called ADF, which, for the purpose of improving the document processing performance of a copying machine, permits a plurality of documents to be copied in a plurality of cycles by making the documents be automatically separated, fed and recovered cyclically.

Now, a representative example of the conventional ADF will be described in conjunction with FIGS. 1 to 3.

Referring to FIG. 1 which is a perspective view of the conventional ADF, the ADF generally comprises a document feeding base 1, on which a plurality of documents 7 to be copied are consecutively set in the order of page numbers, and a recovered document base 2 on which recovered documents 9 after copying are piled up neatly.

FIG. 2 is a sectioned view taken along the section line A—A' of FIG. 1. As depicted in this drawing, the conventional ADF also comprises three driving parts, that is, a document feeding part including a document separating and feeding roller 3 and a pair of register rollers 4, a document conveying part including a conveyor drive roller 5 and a conveyor belt 6 supported between the drive roller 5 and a conveyor driven roller 5*a* and a document recovering part comprising a pair of ejection rollers 8.

Here, a circular encoder 10*b* is coaxially connected to a side of the conveyor drive roller 5 by means of a drive shaft 14 to which the encoder 10*b* and the drive roller 5 are commonly connected as depicted in FIG. 3 so that the encoder 10*b* rotates together with the conveyor drive roller 5. The encoder 10*b* is constructed to have a plurality of slits 13 which are radially and circumferentially formed as spaced apart from each other by predetermined intervals. On the other hand to cooperate with the encoder 10*b* there is provided an optical sensor 10*c* comprising a light emitting element 10*d* and a light receiving element 10*e* which are disposed at both sides of the encoder 10*b* to be aligned with the slits 13 of the encoder 10*b*. The light emitted from the light emitting element 10*d* is, therefore, intermittently received by the light receiving element 10*e* through the slits 13 as the encoder 10*b* rotates and this makes the optical sensor 10*c* output a pulse whenever the light is applied from the element 10*d* to the other element 10*e* through the slit 13.

In addition, the three driving parts, that is, the document feeding part, the document conveying part and the document recovering part, are provided with a drive motor (not shown), respectively, so that the known ADF necessitates at least three drive motors.

In the drawings, the reference numerals 10 denotes a document size sensing part and 10*a* is a register sensor of the document size sensing part 10.

In operation of the known ADF having the aforementioned structure, the documents 7, which are set on the document feeding base 1 with each of the documents turned upside down, are picked up one by one by the document separating and feeding roller 3 which then permits the picked-up document 7 to be fed to the document conveying part by way of the register rollers 4. Upon receiving the document 7 fed by the document feeding part, the document conveying part, which comprises the drive and driven rollers 5 and 5*a* and the conveyor belt 6, introduces the document 7 to a predetermined position on a contact glass (not shown) of the copying machine by conveying the document 7 which is laid thereon. At this position, the copying operation of the copying machine is carried out. After the copying operation, the copied document 7 is introduced between the ejection rollers 8 in order to be ejected from the driving parts of the ADF and piled on the recovered document base 2 with the document image face turned upwardly, In the above process, it is required to accurately convey the document 7 so as to exactly align the front end of the document 7 with a reference copying position (shown at the arrow of FIG. 2) of the contact glass because the copying area of a copy paper (not shown) is determined according to the document position on the contact glass. This thus necessitates a document size sensing operation of the ADF, To achieve this sensing operation, the CPU of the ADF counts the number of pulses which has been applied from the optical sensor 10*c* thereto for a time interval between a time when the register sensor 10*a* of the document size sensing part 10 senses the front end of the document 7 and another time when the sensor 10*a* senses the rear end of the document 7, thereby detecting the document size, that is, the length of the fed document 7.

After the document size sensing operation, the conveyor belt 6 of the document conveying part conveys the document 7 to a reference copying position on the contact glass corresponding to the detected size of the document 7, thereby permitting the document to be exactly positioned on the copying position. The document 7 after the copying operation is then introduced between the ejection rollers 8 in order to be ejected from the driving parts of the ADF and piled on the recovered document base 2.

However in conveying the document 7 to the corresponding copying position on the contact glass in accordance with the length of the document 7 sensed by the document size sensing part 10, there may occur a slip of the document 7 relative to the conveyor belt 6 due to different sizes and weights of the documents 7 and this entails misalignment of the document 7 with the reference copying position on the contact glass. In result, the known ADF has a disadvantage in that it causes the document 7 to be prevented from being exactly copied. In addition as described above, the known ADF inevitably includes at least three drive motors because the three driving parts, that is, the document feeding part, the document conveying part and the document recovering part, are provided with a drive motor, respectively, and this entails increase of manufacturing cost. On the other hand, the known ADF generates a noise caused by solenoids and spring clutches which are inevitably provided to control the power transmission. Additionally, the motors, the solenoids and the spring clutches are obliged to make the known ADF be complex and this introduces a problem in maintenance of the ADF.

In an effort to solve the above disadvantages, there has been proposed other types of ADFs, for example, an ADF having a drive motor for commonly driving the document feeding part and the document conveying part or for commonly driving the document conveying part and the document recovering part. However, these types of ADFs have a disadvantage, respectively, in that they do not permit the parts, which are commonly driven by the drive motor, to be smoothly driven, Particularly, in the case of a known ADF additionally provided at the document feeding part thereof with a document pick-up assembly, an additional disadvantage is introduced due to a subsidiary control member, such as a solenoid for controlling the power transmission for the document pick-up assembly, or an additional drive motor for independently driving the document pick-up assembly.

On the other hand to solve the misalignment of the document with the reference copying position of the contact glass due to occurrence of the slip of the document relative to the conveyor belt, it has been proposed to provide a reversed directional movement function for the conveyor belt. However in this case, the conveyor belt has to start its reversed directional movement for a new document after the previous document has been completely discharged from the document recovering part and this arrangement also introduces a structural problem to the ADF because the ADF is inevitably provided with additional drive motor in consideration of the efficiency of copying work, that is, the copies per minute (CPM).

SUMMARY OF THE INVENTION

It is, therefore, an object of the present invention to provide an automatic document feeder for a copying machine in which the above disadvantages can be overcome and which includes three driving parts which are commonly driven by a drive power source and comprise a document feeding part for picking up and separating the documents to be copied one by one, a belt type document conveying part having forward and reversed directional movement function for exactly setting the document on a reference copying position of a contact glass of the copying machine and a document recovering part for smoothly recovering the copied document.

It is another object of the present invention to provide a method for controlling an automatic document feeder for a copying machine which makes all the driving parts of the document feeder commonly operate by the drive power provided by a drive power source and causes a document recovering operation for a copied document and a document feeding operation for a newly fed document to be carried out at the same time in consideration of sizes of the newly fed and previously copied documents, thereby improving the efficiency of copying work, that is, the copies per minute (CPM) of the document feeder.

It is a further object of the present invention to provide an improved structure of a document feeding part of an automatic document feeder for a copying machine which can prevent a front end of each document from being damaged during the picking-up and separating operation of the document feeding part and keep off a malfunction of the document feeding part.

It is yet another object of the present invention to provide an improved structure of a document recovering part of an automatic document feeder for a copying machine which can prevent each recovered document from flying away due to a faster rotating speed of ejection rollers of the document recovering part and can cause the recovered documents to be piled up neatly on a recovered document base.

In an aspect, the present invention provides an automatic document feeder for a copying machine comprising: document feeding base means for permitting a plurality of documents to be copied to be consecutively set thereon; drive power source means for providing forward and reversed directional drive power useful for document feeding, document conveying and document recovering operations of said document feeder; document feeding means for separating and feeding one by one the documents set on said document feeding base means using the forward directional drive power transmitted from said drive power source means, said document feeding means being applied with only the forward directional drive power by means of an one way clutch and being selectively operated using a part of the forward directional drive power which is selectively transmitted thereto by means of a clutch gear; document conveying means for conveying using the forward directional drive power the document in the forward direction and exactly setting using the reversed directional drive power the document on a predetermined reference copying position of the copying machine, said document conveying means being directly applied with the forward and reversed directional drive power from the drive power source means; document recovering means for recovering using the forward directional drive power of the drive power source means the document after a copying operation; recovered document base means for permitting a plurality of recovered documents to be consecutively piled up thereon, said recovered document base means being formed as disposed below the document feeding base means and being lower than a document ejection position of said document recovering means, thereby causing the recovered documents to be neatly piled up thereon; and at least one document neatening member for preventing each said recovered document from flying away due to faster document ejecting speed of said document recovering means and causing the recovered documents to be piled up neatly on said recovered document base means, said document neatening member being mounted on an under surface of said document feeding base means, In another aspect, the present invention provides a control circuit for automatically controlling an automatic document feeder for a copying machine comprising: a central control unit for controlling said document feeder to be automatically operated using the drive power outputted from drive power source means, a semicircular pick-up roller of document feeding means to cause a document contact plane surface thereof to be level with a document feeding base, a reversed directional movement of a document to be copied to cause the document be exactly set on a contact glass of the copying machine and the document feeder to carry out its operation in consideration of a time when only a document recovering operation for the copied document is carried out or said document recovering operation and a document feeding operation for a new document are carried out at the same time; an interface for interfacing said central control unit to a copying machine control circuit, said interface outputting and being applied with control signals and data to and from said copying machine control circuit; a motor drive unit for driving said drive power source means under the control of the central control unit, said motor drive unit being coupled to an output of the central control unit; an electronic clutch for selectively driving a document separating roller drive shaft of the document feeding means under the control of the central control unit, said electronic clutch being coupled to an output of the central control unit; a display for displaying an operational state of the document feeder under the control of the central control unit, said display being coupled to an output of the central control unit; a document sensor for detecting whether there is the document to be copied and outputting a signal corresponding to the detected document state to the central control unit, said document sensor being coupled to an input of the central control unit; document size sensing means for sensing a size of the document and outputting a signal corresponding to the sensed document size to the central control unit, said document size sensing means being coupled to an input of the central control unit; and pick-up roller state sensing means for sensing a positional state of the semicircular pick-up roller and outputting a signal corresponding to the sensed positional state to the central control unit, said pick-up roller state sensing means being coupled to an input of the central control unit.

In further aspect, the present invention provides a method for automatically controlling an automatic document feeder for a copying machine, which document feeder comprises a central control unit to which an interface, a motor drive unit, an electronic clutch, a display, a document sensor, document size sensing means and pick-up roller state sensing means are coupled, the method comprising the steps of: a) determining, upon checking a signal having been outputted from said document sensor, whether a document to be copied is set on a document feeding base; b) if no document to be copied is set on said document feeding base, determining, upon checking a signal having been outputted from said pick-up roller state sensing means, whether said semicircular pick-up roller has been in its stand-by state, if the semicircular pick-up roller has not been in its stand-by state, driving said electronic clutch as well as said motor drive unit so as to cause the semicircular pick-up roller to achieve its stand-by state, thereafter, returning to the start step and waiting for a document which is to be newly set on the document feeding base; c) if a document to be copied is set on the document feeding base, determining, upon checking all the operational states of the document feeder, whether there has occurred an abnormal operational state in the document feeder, thereafter, if there has occurred an abnormal operational state, displaying the occurrence of the abnormal operational state by means of said display and waiting for removal of the abnormal operational state; d) if there has occurred no abnormal operational state in the document feeder, waiting for a copying start signal which is to be applied from a copying machine control circuit to said central control unit; e) upon receiving the copying start signal having been outputted from said copying machine control circuit, determining whether a document feeding start signal has been inputted; f) if the document feeding start signal has been inputted, driving the electronic clutch, which causes the drive power of drive power source means to be selectively transmitted to a document separating roller drive shaft, for a predetermined time, thereby separating and feeding the document to be copied; g) conveying in the forward direction the document to be copied to a copying position simultaneously with sensing a size of the conveyed document and moving in the reversed direction the document to cause the document to be exactly set on a predetermined reference copying position of a contact glass of the copying machine; h) outputting a document setting end signal to the copying machine control circuit to cause a copying operation to be carried out by the copying machine and waiting for a document recovering start signal which is to be outputted from the copying machine control circuit; i) upon receiving the document setting end signal having been outputted from the copying machine control circuit, determining whether another document to be copied is set on the document feeding base; and j) if there is another document to be copied on the document feeding base, carrying out only a document recovering operation for the copied document in accordance with a time when only the document recovering operation for the copied document is carried out and another time when the document recovering operation for the copied document and a document feeding operation for a new document are carried out at the same, each time being determined in consideration of a length of the new document, then returning to the step (e) so as to repeatedly perform the above steps (e) to (j), thereafter, if there is no document to be copied on the document feeding base, carrying out only a document recovering operation for the last copied document.

BRIEF DESCRIPTION OF THE DRAWINGS

The above and other objects, features and other advantages of the present invention will be more clearly understood from the following detailed description taken in conjunction with the accompanying drawings, in which:

FIGS. 7A to 7D are enlarged views showing an embodiment of a document feeding part of the document feeder according to the present invention, respectively, in which:

FIG. 7A is a schematic side view of the document feeding part;

FIG. 7B is a schematic plane view of the document feeding part;

FIG. 7C is an enlarged perspective view showing the relative position of a semicircular pick-up roller of the document feeding part with respect to a pick-up roller state sensing assembly; and FIG. 7D is a bottom perspective view showing an embodiment of a document separating assembly of the document feeding part;

DETAILED DESCRIPTION OF THE PREFERRED EMBODIMENTS

Figure 4:
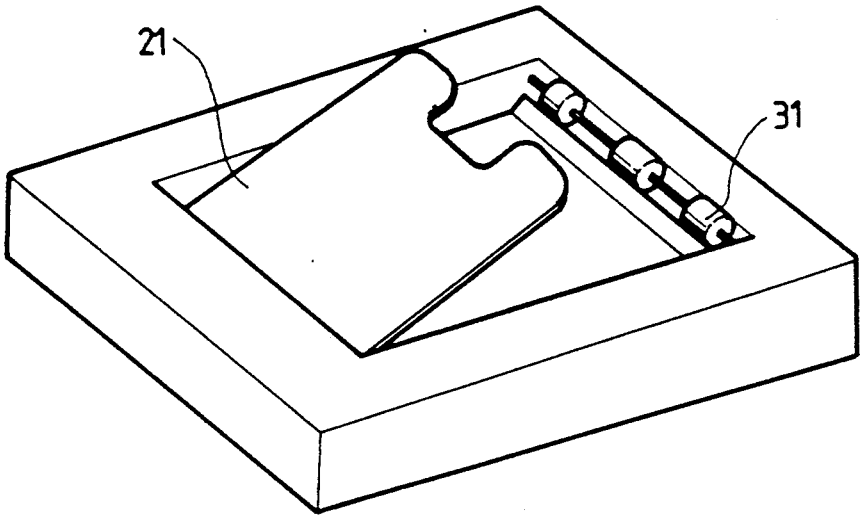
FIG. 4 is a view corresponding to FIG. 1, but showing the present invention.
Figure 5:
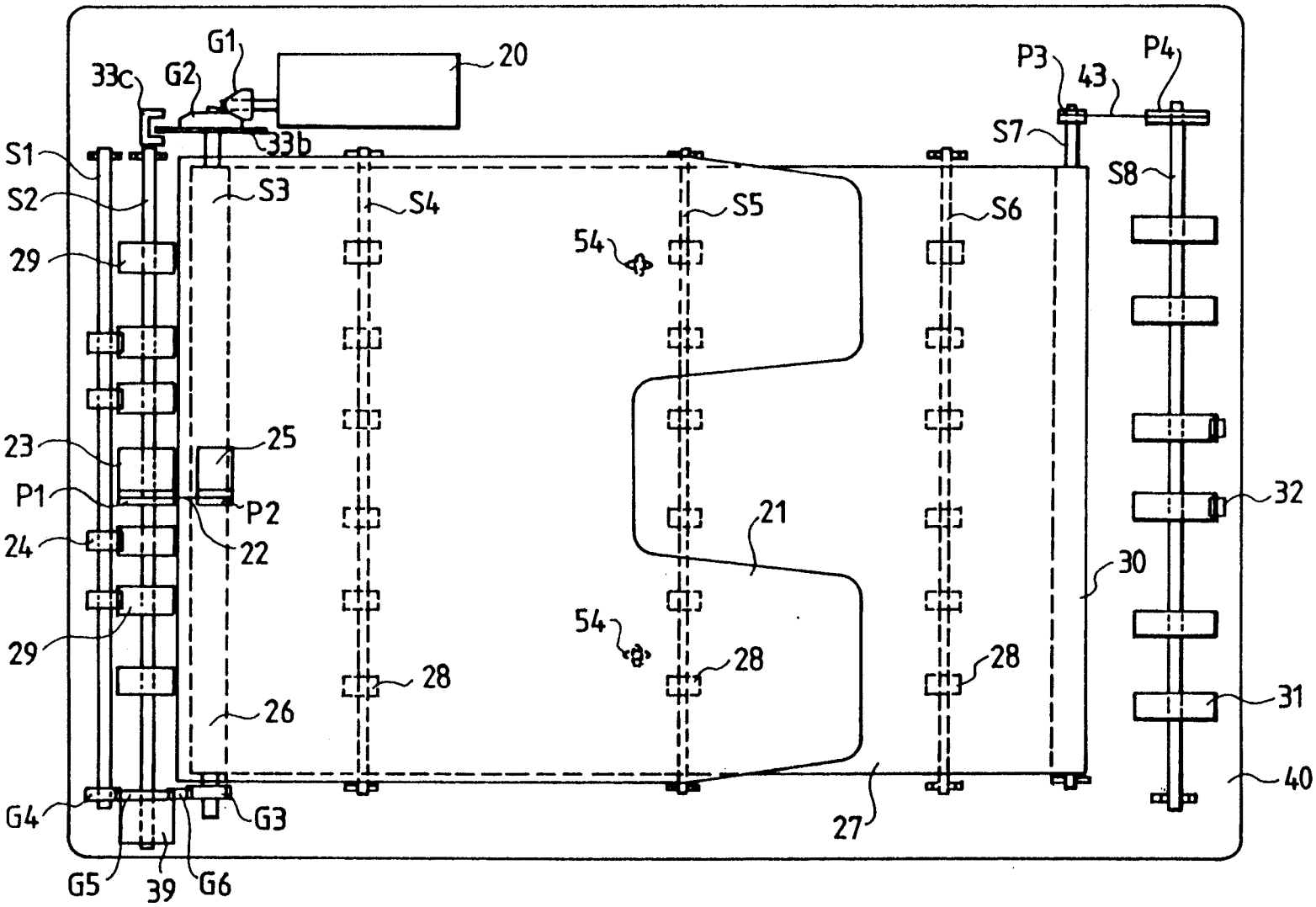
FIG. 5 is a plane view of the document feeder of FIG. 4.
Figure 6:
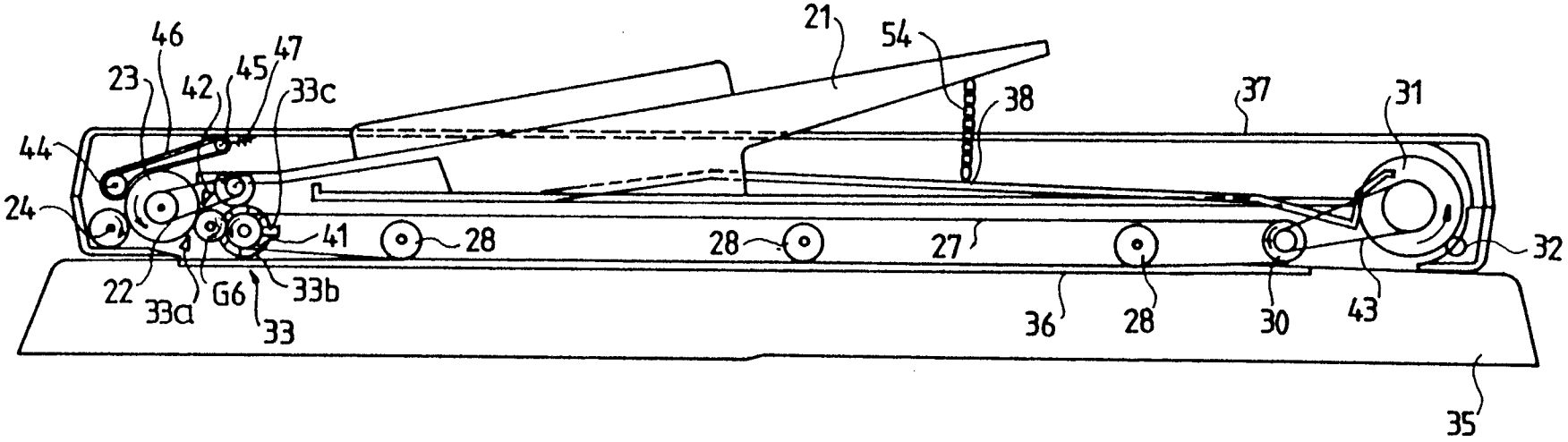
FIG. 6 is a side view of the document feeder of FIG. 4.

Referring first to FIGS. 4 to 6, FIG. 4 is a perspective view showing an automatic document feeder installed on a copying machine in accordance with the present invention, FIG. 5 is a plane view of the document feeder of FIG. 4 and FIG. 6 is a side view of the document feeder of FIG. 4.

As depicted in the drawings, the present document feeder comprises a document feeding base 21, on which a plurality of documents 7 to be copied are consecutively set in the order of page numbers, and a reversible motor 20 for providing drive power for the document feeder. Here, the reversible motor 20 supplies the driving power to all of drive parts of the document feeder so as to allow the drive parts to carry out document feeding, document conveying and document recovering operations.

This document feeder also comprises a document feeding part which separates and feeds the documents to be copied set on the document feeding base 21 using a forward directional drive power transmitted from the reversible motor 20 and a document conveying part which is driven by the drive power directly received from the reversible motor 20 regardless of the rotational direction of the motor 20 and conveys the document fed by the document feeding part to a copying position of a contact glass 36 of the copying machine 35 simultaneously with performing a reversed directional motion for exactly setting the document on a predetermined reference copying position. In addition, a document recovering part is provided to eject using the drive power of the reversible motor 20 the document after the copying operation from the drive parts of the document feeder. Each document ejected from the document recovering part is then piled up on a recovered document base 38.

To achieve such a power transmission from the reversible motor 20 to each drive part, the motor 20 engages with an end of a document conveyor roller drive shaft S3 to cause the shaft S3 to rotate in forward or reversed direction in response to the motor's rotational direction. The conveyor roller drive shaft S3 is provided at the other end with an one way clutch G3 which in turn engages with an electronic clutch gear G5 with an idle gear G6 interposed therebetween so that the electronic clutch gear G5 is not applied with the reversed directional drive power but, the forward directional drive power from the one way clutch gear G3 by way of the idle gear G6. In addition, the electronic clutch gear G5 is connected at a side thereof to an electronic clutch 39 which permits a document separating roller drive shaft S2, which is connected to the other side of the electronic clutch gear G5 as being parallel to the conveyor roller drive shaft S3, to selectively rotate in the same direction as that of the conveyor roller drive shaft S3.

The electronic clutch gear G5 of the separating roller drive shaft S2 also engages with a register roller drive gear G4 which is applied with the forward directional drive power from the electronic clutch gear 65. Here, the register roller drive gear G4 is connected to a register roller drive shaft S1 which is parallel to the aforementioned drive shafts S2 and S3 and rotates in the opposite direction to the conveyor roller drive shaft S3. In addition, a conveyor belt 27 is supported between a conveyor roller 26 supported by the conveyor roller drive shaft 83 and a conveyor driven roller 30 supported by a conveyor driven shaft S7, thereby causing the document conveying part to be applied with the rotational power of the reversible motor 20 regardless of the rotational direction of the motor 20. To accomplish the document conveying part, besides the conveyor driven shaft S7, three intermediate shafts S4 to S6 are arranged between the conveyor roller drive shaft S3 and the driven shaft S7. The four shafts S4 to S7 thus cooperates with the conveyor roller drive shaft S3 by means of the conveyor belt 27. On the other hand, the conveyor driven shaft S7 of the document conveying part is connected to an ejection roller drive shaft S8 of the document recovering part by means of a drive belt 43 which is supported therebetween, thereby causing the ejection roller drive shaft S8 to rotate in the same direction as that of the conveyor roller drive shaft S3.

Briefly described, the document feeder of this invention is provided with the one way clutch gear G3 in order to cause the rotational power of the reversible motor 20 in the case of the reversed directional rotation not to be transmitted to the document feeding part but to be directly transmitted to a conveyor roller 26 supported by the conveyor roller drive shaft S3 of the document conveying part, The present document feeder is, additionally, provided with the electronic clutch 39 which permits a cylindrical document separating roller and a semicircular pick-up roller to be selectively driven as required. Thus, it is possible to drive the document feeder by one drive motor.

As depicted in FIGS. 5 and 6, the reversible motor 20 is provided at a free end of its drive shaft with a bevel drive gear G1, while the one end of the conveyor roller drive shaft S3 is provided with a bevel driven gear G2 which engages with the bevel drive gear G1 of the reversible motor 20. The conveyor roller drive shaft S3 is thus directly applied with the rotational power of the reversible motor 20 so as to rotate in the forward and reversed directions, Here, the gearing assembly for directly transmitting the rotational power of the reversible motor 20 to the conveyor roller drive shaft S3 is not limited to the aforementioned bevel gears G1 and G2 but may preferably comprise a worm and worm gear assembly instead of the bevel gears G1 and G2. On the other hand, the document feeding part is driven as applied with the rotational power of the motor 20 which is transmitted by the conveyor roller drive shaft S3 as described above, however, this document feeding part is only applied with the forward directional drive power by virtue of the one way clutch gear G3 mounted to the other end of the conveyor roller drive shaft S3 and engaging with the electronic clutch gear G5 with the idle gear G6 interposed therebetween. Here, the electronic clutch gear G5 is connected at the one side to the electronic clutch and at the other side to the separating roller drive shaft S2 so that, even under the condition that the electronic clutch gear G5 continuously rotates in the forward direction by the forward directional drive power transmitted from the one way clutch gear 83 thereto through the idle gear G6, the separating roller drive shaft S2 selectively rotates because of intermittent power transmission of the electronic clutch 39 and this makes a separating roller 23 supported by the shaft S2 selectively rotate.

Here, a pair of register driven rollers 29 are mounted on the same shaft, that is, the separating roller drive-shaft S2, as that of the separating roller 23 but, to prevent them from being influenced by and/or affecting the rotation of the drive shaft S2, they are structured to have a larger inner diameter than an outer diameter of the drive shaft S2 and are arranged such that they are raced with respect to the drive shaft S2 by minimizing the frictional force generated between the inner surfaces thereof and the outer surface of the drive shaft S2. On the other hand, the cylindrical separating roller 23 and the semicircular pick-up roller 25 are provided at each side thereof with a pulley P1 or P2, respectively. Between the pulleys P1 and P2, a pick-up roller drive belt 22 is supported in order to transmit the rotational power of the separating roller 23 to the pick-up roller 25 as will be in detail described below in conjunction with FIGS. 7A to 7D. A plurality of register rollers 24, of which the number is randomly selected so as to permit a desired efficiency of the document feeder to be achieved, are supported by the register roller drive shaft S1 to rotate together with the shaft S1 and engage with the register driven rollers 29 supported by the separating roller drive shaft S2.

Figure 1:
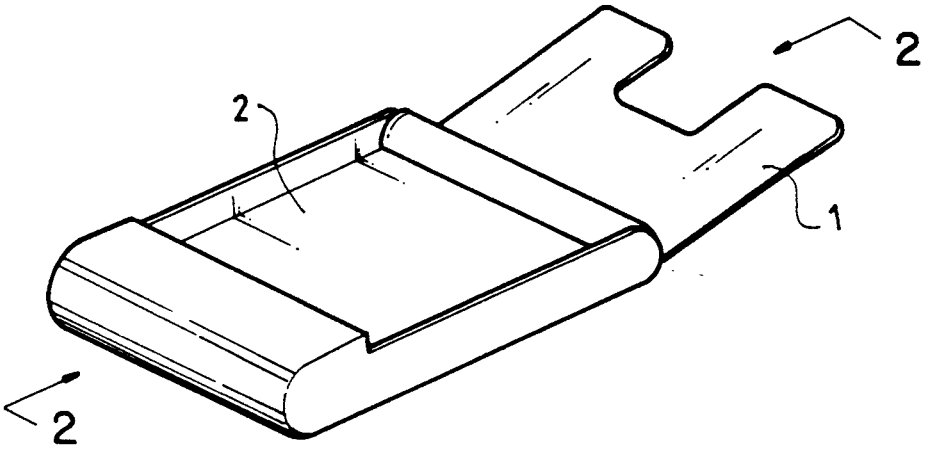
FIG. 1 PRIOR ART
FIG. 1 is a perspective view of an automatic document feeder in accordance with the prior art.
Figure 2:
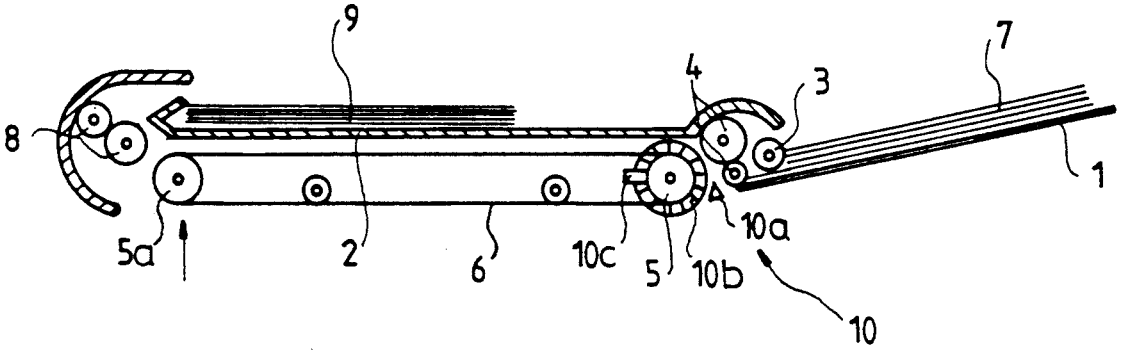
FIG. 2 PRIOR ART
FIG. 2 is a sectional view of the document feeder taken along the section line A—A' of FIG. 1.
Figure 3:
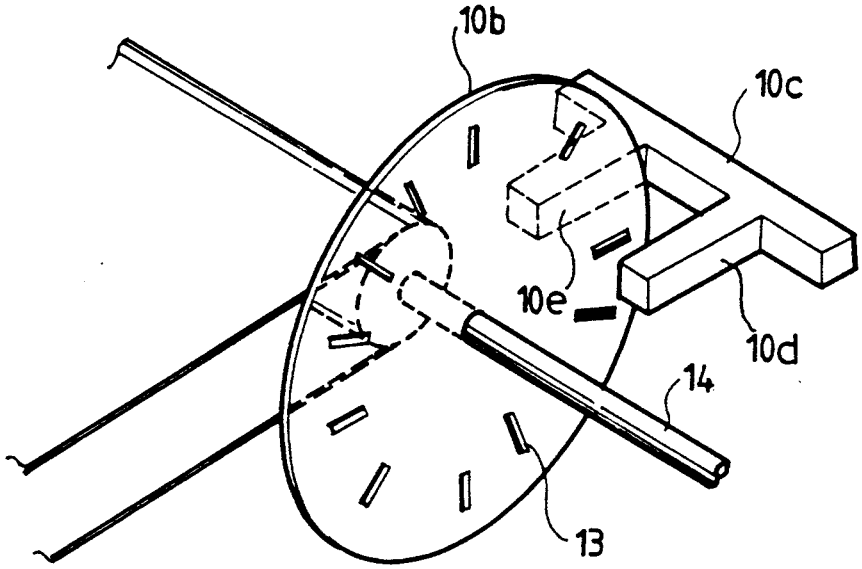
FIG. 3 PRIOR ART
FIG. 3 is a perspective view of a document size sensing part of the document feeder of FIG. 2.

As described in the conventional document feeder, to sense each document size, the document feeding part is provided with a document size sensing assembly 33. The assembly 33 comprises an encoder 33*b* which is mounted on the same shaft, that is, the conveyor roller drive shaft S3, as that of the bevel driven gear G2 and rotates together with the conveyor roller 26 by the rotational power of the reversible motor 20. The encoder 33*b* is constructed to have a plurality of slits which are radially and circumferentially formed as spaced apart from each other by predetermined intervals (see FIG. 3). The assembly 33 also comprises an optical sensor 33*c* for sensing the number of slits of the encoder 33*b* which pass by the optical sensor 33*c* as the encoder 33*b* rotates and a register sensor 33*a* disposed at the rear of the separating roller 23 so as to sense the front and rear ends of document in the feeding operation. Here, the document size sensing assembly 33 permits each document size to be detected by counting the number of pulses outputted from the light receiving element of the optical sensor 33*c* from a time when the register sensor 33*a* senses the front end of the document to another time when the sensor 33*a* senses the rear end of the document. On the other hand to detect whether a document is in the document feeding stand-by state, a document sensor 42 is provided as disposed at the front of the separating roller 23.

The document conveying part includes the conveyor roller 26 supported by the conveyor roller drive shaft S3, the conveyor driven roller 30 supported by the conveyor driven shaft S7, the three intermediate conveyor rollers 28 supported by the three intermediate shafts S4 to S8, each disposed between the two shafts S3 and S7, and the conveyor belt 27 which is supported between the two rollers 26 and 30 with each intermediate roller 28 contacting with the conveyor belt 27 The document conveying part is, therefore, applied with the rotational power, that is, the drive power, of the reversible motor 20 regardless of the rotational direction of the motor 20, thereby causing the document laid on-the conveyor belt 27 to be conveyed to a predetermined position on the contact glass 36 of the copying machine 35 by the forward directional drive power as well as causing the document to be backed in order to be exactly set on the reference copying position on the contact glass 36 by the reversed directional drive power. Here, the number of the intermediate rollers 28 supported by the intermediate shafts is not limited to the above description but variably determined in consideration of the document conveyance efficiency of the document conveying part.

On the other hand, the document recovering part comprises a plurality of ejection rollers 31 each supported the ejection roller drive shaft S8 applied with the drive power from the conveyor driven shaft S7 by way of the drive belt 43 which is supported between the driven shaft S7 and the ejection roller drive shaft S8. Some of the ejection rollers closely contacts with a driven roller 32 which, as the ejection roller 31 rotates, is driven by the contact frictional force generated between it and the ejection roller 31, In detail described, the drive belt 43 is supported between a pulley P3 mounted on an end of the conveyor driven shaft S7 and a pulley P4 mounted on an end of the ejection roller drive shaft S8 so that the ejection roller drive shaft S8 rotates in the same direction as that of the conveyor roller drive shaft S3. In result, it is possible to drive the document recovering part by the rotational power of the reversible motor 20. Here to prevent the document from being jammed in the document recovering part, it is preferred to make the document recovering speed be faster than the document feeding or document conveying speed so that each ejection roller 31 of the document recovering part preferably has a relatively lager outer diameter than those of the rollers of the other parts.

Each ejection roller 31 has the larger outer diameter so as to cause the document recovering speed to be faster than the document feeding or document conveying speed as described above so that the document ejected from the ejection rollers 31 may fly away due to the faster rotating speed of the ejection rollers 31. To solve the flying away of the recovered document, the present document feeder is equipped at both sides of the under surface of the document feeding base 21 with a pair of suspended chains 54 as a document neatening member for preventing each recovered document from flying away but causing the recovered documents to be piled up neatly on the recovered document base 38. Here, the document neatening member may comprise a Mylar film, which is suspended from the under surface of document feeding part in the same manner, instead of the aforementioned suspended chains 54.

In the drawings, the reference numerals 37 denotes an upper cover for protecting the drive parts and 40 denotes a housing of the present document feeder.

Figure 7A:
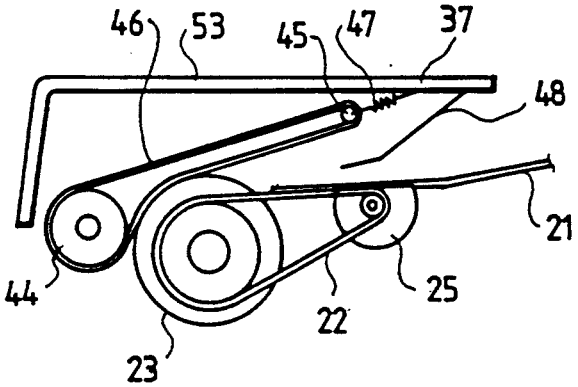
Figure 7B:
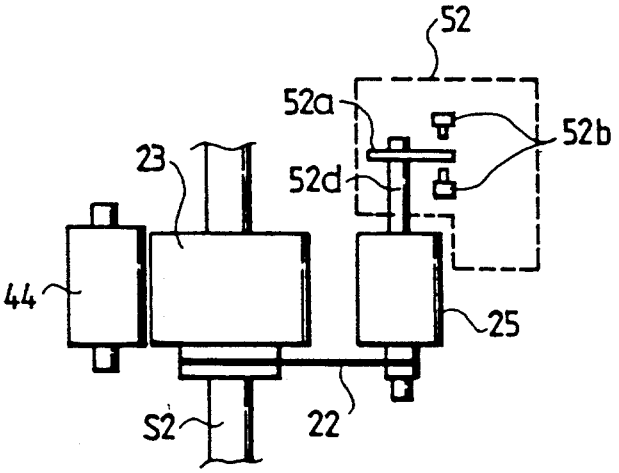
Figure 7C:
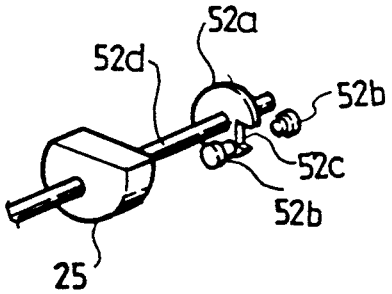
Figure 7D:
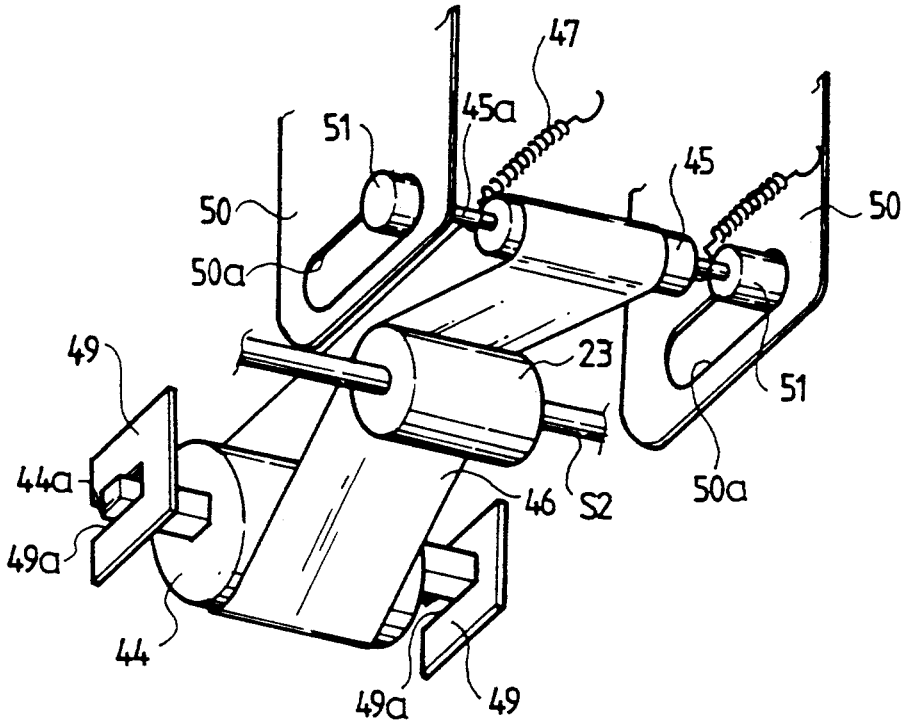

Turning to FIGS. 7A to 7D showing a detailed structure of the document feeding part of this document feeder, respectively, FIG. 7A is a schematic side view of the feeding part, FIG. 7B is a plane view of the feeding part, FIG. 7C is an enlarged perspective view showing the relative position of the semicircular pick-up roller of the feeding part with respect to a pick-up roller state sensing assembly and FIG. 7D is a bottom perspective view showing an embodiment of a document separating assembly of the document feeding part.

In operation of the document feeding part, as the document separating roller 23 starts the rotation by the rotational power of the reversible motor 20 which operates in response to a document feeding signal outputted from the copying machine 35, the rotational power of the separating roller 23 is transmitted to the semicircular pick-up roller 25 by way of the pick-up roller drive belt 22 supported between the two rollers 23 and 25, thereby causing the pick-up roller 25 to rotate in cooperation with the separating roller 23. Thus, the documents piled up on the document feeding base 21 are picked up by the pick-up roller 25 and introduced into the document feeding part wherein the documents are separated and fed one by one by addition of a separating belt 46 and the separating roller 23 which are closely contact with each other. Here, the front end of each document piled up on the document feeding base 21 is downwardly biased by an elastic Mylar sheet 48, which is provided to impart a downward biasing force to the documents set on the base 21, so that it exactly located on the pick-up roller 25.

In the conventional automatic document feeder, a circular pick-up roller is generally provided for picking up the documents on the document feeding base 21 and introducing the documents into the document feeding part, However, as well known to those skilled in the art, this conventional circular pick-up roller entails a problem in that it impedes an introduction of the documents thereto, furthermore, it often causes the front ends of the documents to be crumpled during the document feeding operation. The aforementioned problem of the prior art can be overcome by the semicircular pick-up roller 25 according to this invention. That is, in every stand-by state of the semicircular pick-up roller 25 before a document feeding operation, the pick-up roller 25 is always positioned such that the document contact plane surface thereof is level with the document feeding base 21, thus permitting the documents, when they set on the base 21, to smoothly pass over the pick-up roller 25 without hindrance and, in this respect, preventing a front end of each document from being damaged during the document feeding operation and keeping off a malfunction of the document feeding operation.

In order to achieve the aforementioned positioning of the semicircular pick-up roller 25 with respect to the document feeding base 21, it is required to control the rotation of the pick-up roller 25 in the initial setting operation of the documents on the document feeding base 21, Therefore, there is provided a pick-up roller rotational state sensing assembly 52 cooperating with the pick-up roller 25 as depicted in FIG. 7C. The sensing assembly 52 comprises an encoder **52*a*, which is formed with a slit 52*c* and supported by the same shaft 52*d* as that of the pick-up roller 25 so as to rotate together with the pick-up roller 25, and an optical sensor 52*b* for determining whether the slit 52*c* of the encoder 52*a* aligns therewith. In order to cause the pick-up roller 25 to cooperate with the sensing assembly 52, the encoder 52*a* having the slit 52*c* requires to be mounted on the shaft 52*c* relative to the pick-up roller 25 such that, when the document contact plane surface of the rotatable pick-up roller 25 is level with the document feeding base 21 to achieve the desired stand-by state of the roller 25, a light receiving element of the sensor 52*b* is activated by receiving a light emitted from the light emitting element of the sensor 52*a* as a result of exact alignment of the two elements of the sensor 52*a* with the slit 52*c* of the encoder 52*a*. As described above, the document feeder of this invention causes the reversible motor 20 to drive the pick-up roller 25 before the document separating and feeding operation, thereby causing the pick-up roller 25** to be in the aforementioned stand-by state.

FIG. 7D is a bottom perspective view showing an embodiment of a document separating assembly of the document feeding part of the present document feeder.

In a conventional document separating assembly, a rotatable document separating roller is disposed as closely contacting with a portion of a stationary document separating belt to separate one by one the documents set on a document feeding base. However as well known to those skilled in the art, such a conventional document separating assembly entails a partial abrasion of the stationary belt due to a continuous, partial contact of the belt with the separating roller, in this respect, shortens the using life of the separating belt and impairs the document separating efficiency thereof, Furthermore, this conventional document separating assembly necessitates occurrence of a substantial frictional force between the separating belt and the separating roller before the document is introduced to the nip therebetween and this causes the drive motor of the document feeder to be unnecessarily overloaded.

The aforementioned problem of the conventional document separating assembly can be overcome by the present document separating assembly shown in FIG. 7D. As depicted in the drawing, this document separating assembly comprises an endless document separating plane belt 46 which is supported between a stationary belt roller 44 and a rotatable belt roller 45 and closely contacts with the document separating roller 23. Here, the separating roller 23 closely contacts with the separating belt 46 as if it upwardly biases the belt 46, so that it is well known that the roller 23 also functions as a tension roller for imparting a tensile force to the belt 46. The rotatable roller 45 is supported by a rotating shaft **45*a* which is provided at both ends thereof with a pair of larger diameter supports 51. Each support 51 is in turn movably inserted in a slot 50*a* formed in each side wall of a rotation-side bracket 50, thereby causing the rotatable roller 45 to rotate with the rotating shaft 45*a* rotatably supported by the bracket 50. On the other hand, the stationary roller 44 is supported by a rectangular shaft 44*a* which is integrally equipped to the roller 44 and is in turn inserted in a rectangular slot 49*a* formed in each side wall of a stationary-side bracket 49. The stationary roller 44 is thus prevented from being rotated. Here, the rotating shaft 45*a* is upwardly, backwardly biased by means of biasing means such as a pair of compression coil springs 47 connected between the rotating shaft 45*a* and the upper cover 37 so that the separating belt 46 always closely contacts with the separating roller 23** with an appropriate tensile force as described above.

Here, the separating roller 23 requires to have a relatively higher coefficient of friction than that of the separating belt 46. In addition, it is also required to construct the document separating assembly to have a larger frictional force $F_{b1}$ between the separating roller 23 and the separating belt 46 than the sum total of the frictional forces $F_s$, $F_r$ and $F_{b2}$ each between the separating belt 46 and the stationary roller 44, between the separating belt 46 and the rotatable roller 45 or between the supports 51 of the rotatable roller 45 and the slots 50*a* of the bracket 50. That is, The relation between the aforementioned frictional forces will be described as follows:

$$F_{b1} > F_S + F_r + F_{b2}$$

wherein, $F_{b1}$ is a frictional force between the separating roller 23 and the separating belt 46, $F_s$ is a frictional force between the separating belt 46 and the stationary roller 44, $F_r$ is a frictional force between the separating belt 46 and the rotatable roller 45 and $F_{b2}$ is a frictional force between the supports 51 of the rotatable roller 45 and the slots 50*a* of the bracket 50.

Therefore, in the case of an unloading state wherein no document is nipped between the separating belt 48 and the separating roller 23, the separating belt 46 smoothly moves together with the rotation of the rotatable roller 45 as the separating roller 23*a* rotates. On the contrary, in the case of a loading state wherein a document is nipped between the separating belt 46 and the separating roller 23, the frictional force $F_b$ between the roller 23 and the separating belt 46 is reduced due to the document nipped therebetween and this causes the separating belt to stop its rotation and to feed the document to the document conveying part, In other words, at this time a frictional force between the document and the separating roller 23 is higher than that between the document and the separating belt 46 as a result of the aforementioned difference of the coefficient of friction between the separating roller 23 and the separating belt 46 and this causes the separating belt 46 not to relatively move with respect to the rotating roller 23 but to simply feed the document. On the other hand, even if there are at least two documents nipped between the separating roller 23 and the separating belt 46 at the same ti me, only the lowermost document, that is, a document directly contacting with the separating roller 23, is fed because a frictional force between the separating belt 46 and the uppermost document directly contacting therewith is higher than that between the documents nipped between the roller 23 and the belt 46.

In result, the separating belt 46 does not rotate in case of the document loading state but it rotates in the case of the document unloading state as described above and this causes the whole surface of the separating belt 46 to be evenly abraded. On the other hand, the document separating and feeding efficiency of the separating roller 23 may be reduced as a result of an inevitable abrasion of the separating roller 23 and the separating belt 46 caused by a long time use thereof, however, this problem can be efficiently solved by the structure of this document separating assembly. That is the rotating shaft 45*a* of the rotatable roller 45 is upwardly, backwardly biased by means of the compression coil springs 47 each of which is connected between the rotating shaft 45*a* and the upper cover 37 and, in this respect, causes the separating belt 46 to always closely contact with the separating roller 23 with an appropriate tensile force as described above, thereby efficiently lengthening the using life of the document separating assembly irrespective of the aforementioned inevitable abrasion.

The operation of the present automatic document feeder which is constructed as described above will be described hereinafter.

First, the document separating and feeding operation of the document feeding part is limitedly carried out for a predetermined time when, upon receiving start signals corresponding to document copying and document feeding outputted from the copying machine, the electronic clutch 39 mounted on the separating roller drive shaft S2 is turned on. Here, once the document feeding operation is accomplished by the continuous rotations of the register rollers 24, the intermediate conveyor rollers 28, the conveyor driven roller 30 and the ejection rollers 31, the document is successively conveyed in the forward direction. At this time, the encoder 33*b* and the optical sensor 33*b* of the document size sensing assembly 33 permits each document size to be detected by counting the number of pulses outputted from the light receiving element of the optical sensor 33*c* for a time interval from a time when the register sensor 33*a* senses the front end of the document to another time when the sensor 33*a* senses the rear end of the document. The above document size sensing operation is carried out in order to control the document feeder to operate in such a manner that it carries out the document recovering operation for a previously copied document as well as the document feeding operation for the newly fed document during a successive copying operation. Such simultaneous operations are carried out for a part of the document feeding time and improve the efficiency of copying work, that is, the copies per minute (CPM).

The document is then conveyed to the contact glass 36 of the copying machine 35 as the conveyor roller 26 rotates, however, this document requires to be corrected the misalignment thereof with respect to the reference copying position. Thus, once the document reaches a predetermined position on the contact glass 36, the reversible motor 20 changes its rotational direction in order to start a document setting operation wherein, upon receiving the reversed rotational power from the motor 20, the conveyor belt 27 moves in the reversed direction so as to make the rear end of the document laid thereon be exactly set on the reference copying position of the contact glass 36. That is, once the document reaches the predetermined position on the contact glass 36, it is backed by the aforementioned reversed movement of the conveyor belt 27 to cause its rear end to contact with a scale 72 (see FIG. 10) provided on the contact glass 36 and this permits the document to correct its skewed position with respect to the reference copying position. During this document setting operation caused by the reversed movement of the conveying belt 27, the one way clutch gear G3 is raced so as to transmit no reversed directional drive power to the document separating roller 23.

Upon accomplishing the above document setting operation, the copying machine carries out the copying operation which is followed by the document recovering operation which is to be carried out in response to a document recovering signal. At this time to improve the efficiency of copying work in a successive copying operation, that is, the copies per minute (CPM), the document feeder operates in such a manner that it carries out only the document recovering operation for the copied document for a predetermined part, in consideration of the sensed size of a new document, of the document recovering time, thereafter, it carries out the document recovering operation for the remaining time as well as the document feeding operation for a new document. However, if there is no document to be copied on the document feeding base 21 , the document feeder i s only carried out the document recovering operation to recover the document completely and stops its automatic document feeding operation.

Here upon considering that the document feeding operation and the document recovering operation are be carried out at the same time using the forward directional drive power of the reversible motor 20, it is very important that the document feeder must be optimally control led to permit the copied document to be completely. ejected from the ejection rollers 31 before the new document reaches the predetermined position on the contact glass 36. Otherwise the copied document would be backed as the conveyor belt 27 moves in the reversed direction and this might cause the document to be jammed in the document recovering part and, as a result, prevent any effort to improve the copies per minute (CDM). In result, the present invention provides a document feeder control circuit which is interfaced with a copying machine control circuit and comprises an additional microprocessor as shown in FIG. 8.

Figure 8:
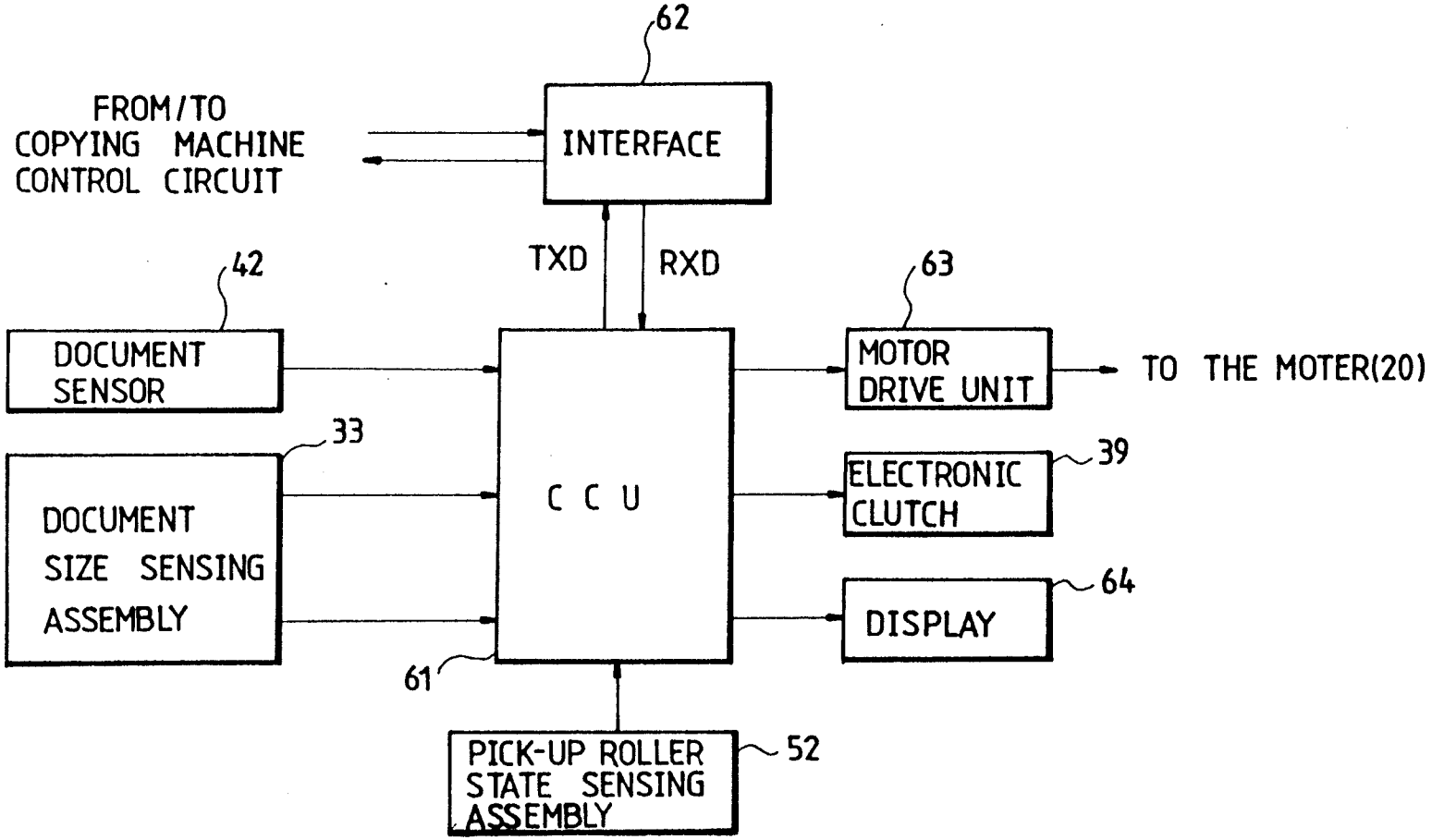
FIG. 8 is a block diagram showing a control circuit for automatically controlling the document feeder of the present invention.

FIG. 8 is a block diagram showing the control circuit for controlling the operation of the document feeder of the present invention. As depicted in the drawing, the circuit comprises a central control unit 61 which has a microprocessor, which is interfaced with the copying machine control circuit, controls all the drive parts of the automatic document feeder to be operated by the rotational power of one reversible motor 20 and contains an operating software for causing a document laid on the conveyor belt 27 to be exactly set on the reference copying position of the contact glass 36 and, as a result, to be exactly copied. The circuit also comprises an interface 62, which interfaces the central control unit 61 to the copying machine control circuit, thereby causing them to output and to be applied with control signals and data to and from each other.

In addition, the central control unit 61 is coupled at its output to a motor drive unit 63 for driving the reversible motor 20 under the control of the central control unit 61, the electronic clutch 39 for causing the document separating roller drive shaft S2 to be selectively driven under the control of the central control unit 61 as described above and a display 64 comprising a LED display circuit for displaying a document feeder operational state under the control of the central control unit 61, respectively. On the other hand, the central control unit 61 is also coupled at its input to the document sensor 42 for sensing a document feeding stand-by state and outputting a signal corresponding to the sensed document state to the central control unit 61 and the document size sensing assembly 33 which is provided to sense each document size and to output a signal corresponding to the sensed document size to the central control unit 61. Here, as described above the document size sensing assembly 33 comprises the register sensor 33*a*, the encoder 33*b* and the optical sensor 33*c*. The central control unit 61 is additionally coupled at its input to the pick-up roller state sensing assembly 52 for sensing a positional state of the semicircular pick-up roller 25 with respect to the document feeding base 21 and outputting a signal corresponding to the sensed positional state to the central control unit 61. As aforementioned, the pick-up roller rotational state sensing assembly 52 comprises the encoder 52*a*, which is supported by the same shaft 52*d* as that of the pick-up roller 25, and the optical sensor 52*b* for sensing a rotational position of the encoder 52*a*.

In operation of the control circuit having the above-mentioned structure, the central control unit 61 interfaced with the copying machine control circuit often outputs and is applied with control signals and data to and from the copying machine control circuit through the interface 62 and also applied with signals corresponding to the sensed document state and the sensed document size from the document sensor 42 and the register sensor 33*a* of the document size sensing assembly 33, respectively. That is, the document sensor 42 detects whether a document to be copied is set on the document feeding base 21 and outputs a signal corresponding to the sensed document state to the central control unit 61 which, upon receiving the signal, determines whether the automatic document feeding operation is continued. Also, the register sensor 33*a* of the document size sensing assembly 33 permits the central control unit 61 to be informed of the time when the front or rear end of the fed document passes by the register sensor 33*a*. That is, the central control unit 61 determines a size of each fed document by counting the number of pulses outputted from the optical sensor 33*c* in cooperation with the encoder 33*c* for a time interval between a document front end sensing time and a document rear end sensing time, each sensed by the register sensor 33*a*. The information of the document size determined by the central control unit 61 is important data useful for controlling the document conveying operation and the document recovering operation in the case of the successive copying operation.

On the other hand, the motor drive unit 63 is provided in order to control the forward and reversed rotation of the reversible motor 20, which provides the drive power for all the drive parts of the present document feeder, under the control of the central control unit 61. As described above, the electronic clutch 39 causes, upon receiving a control signal outputted from the central control unit 61; the document separating roller drive shaft S2 to be selectively applied with the drive power in such a manner that it is only applied with the drive power in the case of a document separating and feeding operation and, as a result, causes the separating roller 23 to cooperate with the semicircular pick-up roller 25. The display 64 displays the operational states of the document feeder, such as a document setting state, an occurrence of operational error of the document feeder and etc., so that the user is easily informed of the operational states of the document feeder.

Figure 9:
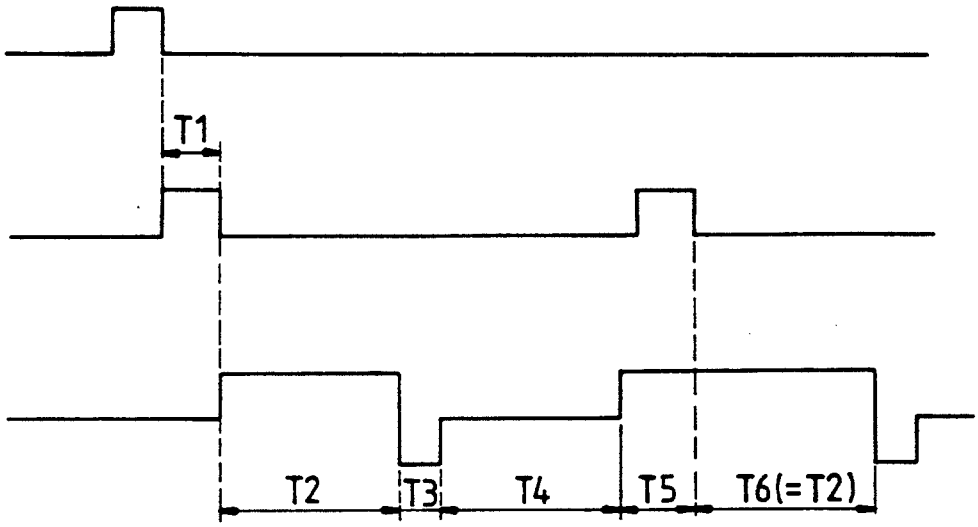
FIG. 9 is a timing diagram showing an embodiment of an operational timing of the present document feeder in case of a successive document feeding.

FIG. 9 is a timing diagram showing an embodiment of an operational timing of the present document feeder in the case of a successive document feeding.

In the drawing, T1 denotes a time when the electronic clutch 39 is activated in order to drive the separating roller 23, T2 denotes a time between a document front end sensing point and a document rear end sensing point, each time being sensed by the register sensor 33*a* of the document size sensing assembly 33, T3 denotes a time when the document is backed in order to exactly align the rear end thereof with the scale 72 of a reference copying position of the contact glass 36, T4 denotes a time when the copying machine carries out the copying operation, T5 denotes a time when the document feeder carries out only the document recovering operation for the copied document and T6 denotes a time when the document feeder carries out the document recovering operation for the copied document together with the document feeding operation for a new document. Here, the time T6 is equal to the time T2 in the case of an automatic document feeding of the documents of the same size.

Especially in the successive operations of the document feeder, the document feeder requires to completely eject the copied document from the ejection rollers 31 of the document recovering part before the new document on the contact glass 36 is backed in order to exactly align the rear end thereof with the scale 72 of a reference copying position of the contact glass 36, as described above. The central control unit 61 thus determines, in consideration of the document size determined thereby the time T5 when the document feeder carries out only the document recovering operation for the copied document, thereby controlling the document feeder to efficiently shorten the required time for its whole operation. Such a control is operated by the operating software contained in the central control unit 61 and, in this respect, also easily applied to an automatic document feeding for documents having different sizes.

Figure 10:
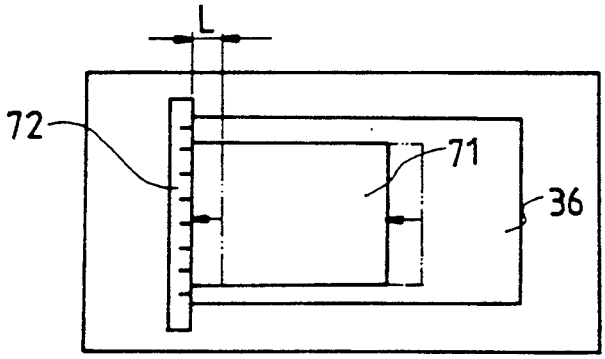
FIG. 10 is a schematic plane view showing a reversed directional movement of the document by the document feeder according to the present invention.

As well known to those skilled in the art, it is very difficult to exactly set a document on a reference copying position of the contact glass 36, however, this problem can be overcome by the automatic document feeder of this invention as shown in FIG. 10 which is a schematic plane view showing the backward movement of a document to be exactly set on a reference copying position of the contact glass 36 of the copying machine 35.

With Reference to the drawing, this document feeder makes the document 71 be conveyed to a predetermined position of the contact glass 36 exceeding a reference copying position by a distance L, then drives the conveyor belt 27, on which the document is closely laid, to move in the reversed direction for a predetermined time. In result, the rear end of document 71 is exactly aligned with the scale 72 of the contact glass 36, thereby causing the document 71 to be exactly set on the reference copying position of the contact glass 36.

Figure 11A:
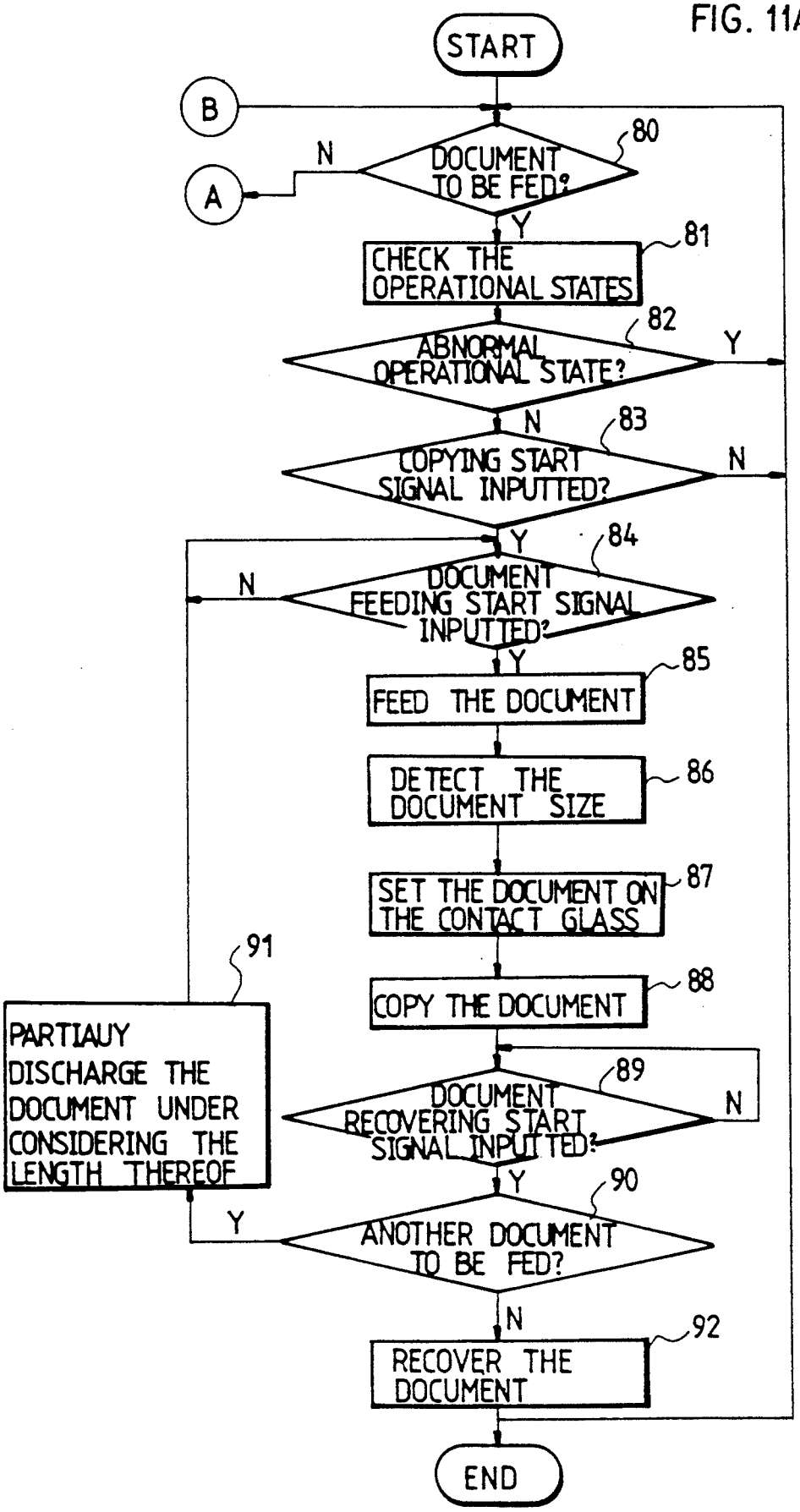
FIGS. 11A and 11B show a flow diagram suitable for controlling the central control unit 61 and associated circuit of FIG. 8 to perform the automatic document feeding operation of the invention, respectively.
Figure 11B:
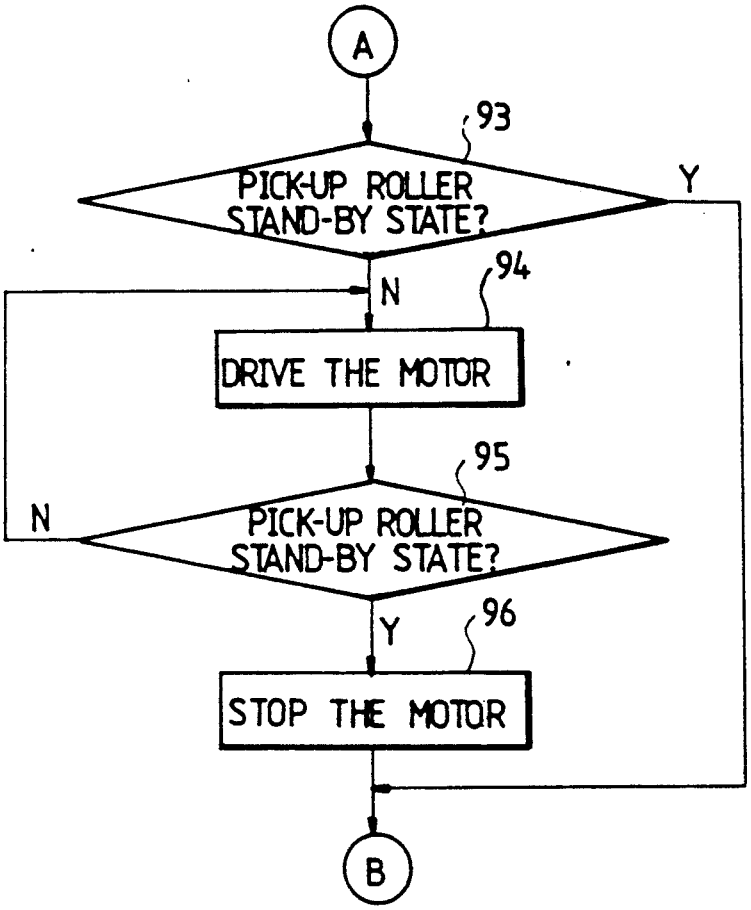

FIGS. 11A and 11B show flow diagrams suitable for controlling the central control unit 61 and associated circuit of FIG. 8 to perform the automatic document feeding operation of the invention, respectively.

Referring to FIG. 11A, at an inquiry step 81 the central control unit 61 determines, upon checking a document state signal having been outputted from the document sensor 42, whether a document to be copied is set on the document feeding base 21 , If the answer is no, at an inquiry step 93 the control unit 61 checks a signal having been outputted from the optical sensor 52*b* of the pick-up roller state sensing assembly 52 to determine whether the semicircular pick-up roller 25 has been in its stand-by state wherein the document contact plane surface thereof is level with the document feeding base 21. If the semicircular pick-up roller 25 has been in its stand-by state, the unit 61 controls the process to return to the start step and retards the process until a document is newly set on the document feeding base 21. However if the semicircular pick-up roller 25 has not been in its stand-by state, the unit 61 performs a next step 94 wherein it drives the electronic clutch 39 as well as the motor drive unit 63 so as to cause the semicircular pick-up roller 25 to achieve its stand-by state. Thereafter, at a step 95 the unit 61 determines whether the pick-up roller 25 has achieved its stand-by state, then stops the reversible motor 20 at a next step 96. Thereafter, the unit 61 controls the process to return to the start step and retards the process until a document is newly set on the document feeding base 21. In this state, if it is determined at the step 80 that there is a document to be copied on the document feeding base 21, the unit 61 performs a step 81 wherein all the operational states of the drive parts of the document feeder are checked then determines at a step 82 whether there has occurred an abnormal operational state such as due to a document jam, the opened document feeder and etc. If it is determined that there has occurred an abnormal operational state, the unit 61 displays the occurrence of the abnormal operational state by means of the display 64 and makes the process to return to the start step in order to wait for removal of the abnormal operational state. However if it is determined that all the drive parts of the feeder are in normal condition, the unit 61 determines at a next step 83 whether a copying start signal has been applied from the copying machine thereto and determines at a step 84 whether a document feeding start signal has been inputted. If it is determined that the copying start signal and the document feeding start signal have been inputted, the unit 61 performs a next step 85 wherein the electronic clutch 39, which causes the rotational power of the reversible motor 20 to be selectively transmitted to the document separating roller drive shaft S2, is activated for a predetermined time and, in this respect, the document to be copied is separated and fed for the predetermined time.

As described above, once the document to be copied is separated and fed by the document separating roller 23, the document is continuously conveyed in the forward direction for a predetermined time with the conveyor belt 27 which forwardly moves by means of the rotating register rollers 24, the rotating conveyor roller 26, the rotating intermediate conveyor rollers 28 and the rotating conveyor driven roller 30 and on which the document is closely laid. Turning to the flow diagram, at a step 86 the unit 61 is applied with a pulse signal corresponding to a size of the fed document from the document size sensing assembly 33 so that it is informed of the document size. The information of the document size is important data useful for efficiently controlling the document conveying operation and the document recovering operation the case of a successive copying operation.

On the other hand, once the document conveying operation, wherein the document is conveyed to the predetermined position of the contact glass 36 exceeding the predetermined reference copying position by the distance L, has been accomplished, the unit 61 performs a step 87 wherein the reversible motor 20 is controlled to rotate in the reversed direction so that the conveyor belt 27 moves in the reversed direction together with the document laid thereon and this causes the document to be exactly set on the reference copying position of the contact glass 36 of the copying machine 35. After the setting of the document on the reference copying position of the contact glass 36, the unit 61 outputs a document setting end signal to the copying machine control circuit and waits for a document recovering start signal which is to be applied from the copying machine control circuit thereto. Upon receiving the document setting end signal having been outputted from the unit 61, the copying machine control circuit controls at a step 88 the copying machine to carry out the copying operation, in turn outputs the document recovering start signal to the unit 61 of the document feeder control circuit. At a step 89 it is determined whether the document recovering start signal has been inputted from the document feeder control circuit. If the answer is yes, the unit 61 performs a next step 90 wherein it is determined whether there is another document to be copied on the document feeding base 21. If there is another document to be copied on the base 21, at a step 91 the unit 61 carries out only the document recovering operation for a time T5 when only the document recovering operation for the copied document is carried out. Here, the time T5 is selected to improve the copies per minute (CPM) at maximum in consideration of a length of a newly fed document as described above. Turning to the flow diagram, the process returns to the step 84 wherein it is determined whether a new document feeding start signal has been inputted. If it is determined that the new document feeding start signal has been inputted, the unit 61 performs the aforementioned steps 84 to 91, wherein the above-mentioned operations such as the document feeding operation, the copying operation, the document recovering operation and etc.. Here, at the step 85 the unit 61 carries out the document recovering operation for the copied document together with the document feeding operation for the newly fed document for a time T6 when the document recovering operation and the document feeding operation are carried out at the same time as described above. The time T6 is also selected to improve the copies per minute (CPM) at maximum in consideration of the length of the newly fed document as described above. In addition, as described above the two time T5 and T6 must be determined to permit the copied document to be completely ejected from the ejection rollers 31 before the new document reaches a predetermined position of the contact glass 36 exceeding a reference copying position by a distance. After repeatedly performing the steps 84 to 91, if it is determined, at the step 90, that there no document to be copied on the document feeding base 21, the unit 61 performs a step 92 wherein only a document recovering operation for the last copied document is carried out, in turn ends the process.

As described above, the present invention provides an automatic document feeder installed on a copying machine in which one reversible motor provides the drive power for all of drive parts of the document feeder, that is, a document feeding part, a document conveying part and a document recovering part, so that the manufacturing cost of the feeder is substantially reduced. In addition, the document feeder of this invention causes the document to be copied to be exactly set on a reference copying position of a contact glass of the copying machine and, in this respect, improves the operational efficiency of the automatic document feeding operation. On the other hand, the present invention provides a control circuit for controlling such an automatic document feeder which comprises a microprocessor useful for efficiently controlling the operations of the document feeder even in the case of feeding of documents having different sizes and in the case of addition of other operational functions to the document feeder. Furthermore, the document feeder is provided with a document separating belt, which selectively moves and closely contacts with a document separating roller, thus improving the document separating efficiency and lengthening the using life of the document feeding part thereof.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. An automatic document feeder for a copying machine comprising:

a. document feeding base means for permitting a plurality of documents to be copied to be consecutively set thereon;

b. drive power source means for providing forward and reversed directional drive power useful for document feeding, document conveying and document recovering operations of said document feeder;

c. document feeding means for separating and feeding one by one the documents set on said document feeding base means using the forward directional drive power transmitted from said drive power source means, said document feeding means being applied with only the forward directional drive power by means of an one way clutch and being selectively operated using a part of the forward directional drive power which is selectively transmitted thereto by means of a clutch gear;

d. document conveying means for conveying using the forward directional drive power the document in the forward direction and exactly setting using the reversed directional drive power the document on a predetermined reference copying position of the copying machine, said document conveying means being directly applied with the forward and reversed directional drive power from the drive power source means; document recovering means for recovering using the forward directional drive power of the drive power source means the document after a copying operation; and e. recovered document base means for permitting a plurality of recovered documents to be consecutively piled up thereon, said recovered document base means being formed as disposed below the document feeding base means and being lower than a document ejection position of said document recovering means, thereby causing the recovered documents to be neatly piled up thereon;

f. wherein said document conveying means comprises:

(1) a conveyor belt for conveying forwards and backwards the document laid thereon, said conveyor belt being supported and driven by a plurality of rollers, said plurality of rollers comprising:

(2) a conveyor roller for driving using the forward and reversed directional drive power of the drive power source means said conveyor belt to move forwards and backwards, said conveyor roller being mounted on a conveyor roller drive shaft which is directly applied with the forward and reversed directional drive power of the drive power source means;

(3) a conveyor driven roller for supporting, in cooperation with the conveyor roller, the conveyor belt to move forwards and backwards, said conveyor driven roller being mounted on a conveyor driven shaft; and (4) at least one intermediate conveyor roller for improving the document conveyance efficiency, said intermediate conveyor roller being mounted on at least one intermediate shaft which is disposed between said conveyor roller drive shaft and said conveyor driven shaft and of which the number being determined in consideration of the document conveyance efficiency;

g. wherein said document recovering means comprises:

(1) an ejection roller drive belt for transmitting the drive power of said drive power source means to an ejection roller drive shaft of the document recovering means, said ejection roller drive belt being supported between a pulley mounted on an end of said ejection roller drive shaft and a pulley mounted on an end of said conveyor driven shaft of the document conveying means;

(2) at least one ejection roller for ejecting the copied document therefrom, said ejection roller being mounted on the ejection roller drive shaft and having a relatively larger outer diameter than those of rollers equipped in said document feeding means and said document conveying means; and (3) at least one driven roller for ejecting the copied document therefrom in cooperation with the ejection roller, said driven roller contacting with the ejection roller and being rotated together therewith.

2. An automatic document feeder according to claim 1, wherein said document feeder further comprises:

at least one document neatening member for preventing each said recovered document from flying away due to faster document ejecting speed of said document recovering means and causing the recovered documents to be piled up neatly on said recovered document base means, said document neatening member being mounted on an under surface of said document feeding base means.

3. An automatic document feeder for a copying machine comprising:

a. document feeding base means for permitting a plurality of documents to be copied to be consecutively set thereon;

b. drive power source means for providing forward and reversed directional drive power useful for document feeding, document conveying and document recovering operations of said document feeder;

c. document feeding means for separating and feeding one by one the documents set on said document feeding base means using the forward directional drive power transmitted from said drive power source means, said document feeding means being applied with only the forward directional drive power by means of an one way clutch and being selectively operated using a part of the forward directional drive power which is selectively transmitted thereto by means of a clutch gear;

d. document conveying means for conveying using the forward directional drive power the document in the forward direction and exactly setting using the reversed directional drive power the document on a predetermined reference copying position of the copying machine, said document conveying means being directly applied with the forward and reversed directional drive power from the drive power source means; document recovering means for recovering using the forward directional drive power of the drive power source means the document after a copying operation; and e. recovered document base means for permitting a plurality of recovered documents to be consecutively piled up thereon, said recovered document base means being formed as disposed below the document feeding base means and being lower than a document ejection position of said document recovering means, thereby causing the recovered documents to be neatly piled up thereon;

f. wherein said document feeding means comprises:

(1) said one way clutch for transmitting only the forward directional drive power of the drive power source means to the document feeding means;

(2) an idle gear engaging with the one way clutch gear;

(3) an electronic clutch gear engaging with said idle gear, said electronic clutch gear receiving the forward directional drive power from the one way clutch gear by way of the idle gear;

(4) an electronic clutch for selectively driving using a part of the forward directional drive power a document separating roller drive shaft as required, the electronic clutch being applied with the forward directional drive power of the drive power source means from said electronic clutch gear;

(5) a register roller drive gear for transmitting the forward directional drive power of the drive power source means to a register roller drive shaft, said register roller drive gear engaging with the electronic clutch gear and being applied with the forward directional drive power of the drive power source means from the electronic clutch gear;

(6) a document separating roller for separating and feeding the document to be copied, said document separating roller being mounted on said document separating roller drive shaft, thereby being rotated only when the electronic clutch is activated in order to transmit the forward directional drive power of the drive power source means to the document separating roller drive shaft;

(7) at least one register roller for introducing the fed document to said document conveying means, said register roller being mounted on said register roller drive shaft, thereby continuously rotating during a forward directional rotation of the drive power source means;

(8) at least one register driven roller engaging with the register roller, said register driven roller being mounted on the document separating roller drive shaft, having a larger inner diameter than an outer diameter of the document separating roller drive shaft and being installed on the document separating roller drive shaft such that it is raced with respect to the document separating roller drive shaft during its rotation together with the register roller;

(9) a pick-up roller for picking up the document to be copied set on the document feeding base means, said pick-up roller being driven by the drive power transmitted from the drive power source means by way of the document separating roller and having a semicircular shape provided with a document contact plane surface;

(10) a document sensor for detecting whether the document to be copied is set on the document feeding base means; and

(11) document size sensing means for sensing a size of the document to be copied.

4. An automatic document feeder according to claim 3, wherein said document feeding means further comprises:

a document separating belt for separating and feeding the document to be copied in cooperation with said document separating roller, said document separating belt moving due to larger frictional force between said document separating belt and the document separating roller when said document separating belt directly contacts with the rotating document separating roller but stopping movement of said document separating belt, as a result of reduction of the frictional force between said document separating belt and the document separating roller, when there is a document between said document separating belt and the rotating document separating roller;

a stationary belt roller for supporting a side of said document separating belt with a predetermined tensile force to the document separating belt, said stationary belt roller being supported to be stationary;

a rotatable belt roller for supporting the other side of the document separating belt to impart, in cooperation with the stationary belt roller, the predetermined tensile force to the document separating belt, said rotatable belt roller being supported to be rotatable;

a first bracket for supporting the stationary belt roller;

a second bracket for supporting the rotatable belt roller, said second bracket being provided with a slot for causing the tensile force, which is imparted to the document separating belt, to be adjusted;

rotating shaft support means for supporting the rotatable belt roller to be rotatable with respect to the second bracket, said rotating shaft support means being mounted on both ends of a rotating shaft of the rotatable belt roller and being movably inserted in said slot of the second bracket, thereby causing the rotatable belt roller to be rotatable with respect to the second bracket; and a pair of springs for biasing the document separating belt so as to cause the document separating belt to closely contact with the document separating roller, each said springs being connected to an end thereof to the rotating shaft of the rotatable belt roller and at the other end thereof to an upper cover of the document feeder.

5. An automatic document feeder according to claim 4, wherein said document separating roller has a relatively higher coefficient of friction than that of the document separating belt and said document feeding means is constructed such that a frictional force between the document separating roller and the document separating belt is higher than the sum total of frictional forces between the document separating belt and said stationary belt roller, between the document separating belt and the rotatable belt roller and between said rotating shaft support means of the rotatable belt roller and said slot of the second bracket.

6. An automatic document feeder according to claim 3, wherein said document size sensing means comprises:

an encoder, said encoder being mounted on a conveyor roller drive shaft of said document conveying means, being rotated together with a conveyor roller, which is mounted on said conveyor roller drive shaft, and having a plurality of slits;

an optical sensor for sensing the number of slits, which pass by said optical sensor as the encoder rotates, of said encoder; and a register sensor for sensing the front and rear ends of the fed document, said register sensor being disposed at the rear of said document separating roller.

7. An automatic document feeder according to claim 3, wherein said document feeding means further comprises:

pick-up roller state sensing means, said pick-up roller state sensing means including an encoder, which is mounted on the same shaft as that of said pick-up roller so as to rotate together with the pick-up roller and formed with a slit, and an optical sensor for sensing a slit position of the encoder, said encoder being disposed relative to the pick-up roller such that said optical sensor senses the slit position of the encoder when said document contact plane surface of the pick-up roller is level with the document feeding base to achieve a stand-by state of the pick-up roller.

8. A method for automatically controlling an automatic document feeder for a copying machine, which document feeder comprises a central control unit to which an interface, a motor drive unit, an electronic clutch, a display, a document sensor, document size sensing means and pick-up roller state sensing means are coupled, the method comprising the steps of:

(a) determining, upon checking a signal having been outputted from said document sensor, whether a document to be copied is set on a document feeding base;

(b) if no document to be copied is set on said document feeding base, determining, upon checking a signal having been outputted from said pick-up roller state sensing means, whether said semicircular pick-up roller has been in a stand-by state, if the semicircular pick-up roller has not been in the stand-by state, driving said electronic clutch as well as said motor drive unit so as to cause the semicircular pick-up roller to achieve the stand-by state, thereafter, returning to step (a) and waiting for a document which is to be newly set on the document feeding base;

(c) if a document to be copied is set on the document feeding base, determining, upon checking all of a plurality of operational states of the document feeder, whether there has occurred an abnormal operational state in the document feeder, thereafter, if there has occurred in abnormal operational state, displaying an occurrence of the abnormal operational state by means of said display and waiting for removal of the abnormal operational state;

(d) if there has occurred no abnormal operational state in the document feeder, waiting for a copying start signal which is to be applied from a copying machine control circuit to said central control unit;

(e) upon receiving the copying start signal having been outputted from said copying machine control circuit, determining whether a document feeding start signal has been inputted, (f) if the document feeding start signal has been inputted, driving the electronic clutch, which causes the drive power of drive power source means to be selectively transmitted to a document separating roller drive shaft, for a predetermined time, thereby separating and feeding the document to be copied;

(g) conveying in the forward direction the document to be copied to a copying position simultaneously with sensing a size of the conveyed document and moving in the reversed direction the document to cause the document to be exactly set on a predetermined reference copying position of a contact glass of the copying machine;

(h) outputting a document setting end signal to the copying machine control circuit to cause a copying operation to be carried out by the copying machine and waiting for a document recovering start signal which is to be outputted from the copying machine control circuit;

(i) upon receiving the document setting end signal having been outputted from the copying machine control circuit, determining whether another document to be copied is set on the document feeding base; and (j) if there is another document to be copied on the document feeding base, carrying out only a document recovering operation for the copied document in accordance with a time when only the document recovering operation for the copied document is carried out and another time when the document recovering operation for the copied document and a document feeding operation for a new document are carried out at the same, each time being determined in consideration of a length of the new document, then returning to the step (e) so as to repeatedly perform the above steps (e) to (j), thereafter, if there is no document to be copied on the document feeding base, carrying out only a document recovering operation for the last copied document.

* * * * *